United States Patent [19]

Drossbach

[11] 3,955,316

[45] May 11, 1976

[54] POWER SUPPLY FOR MODEL WATERCRAFT

[76] Inventor: Adalbert Drossbach, Finkenstrasse 14, 2150 Buxtehude, Germany

[22] Filed: July 5, 1974

[21] Appl. No.: 486,170

[30] Foreign Application Priority Data

July 5, 1973 Germany ..... 2334215

[52] U.S. Cl. ..... 46/250; 46/93; 46/257

[51] Int. Cl.[2] ..... A63H 23/04

[58] Field of Search ..... 46/93, 243 MV; 104/73; 191/22 C, 23 R, 25, 26

[56] References Cited

UNITED STATES PATENTS

| | | | |
|---|---|---|---|
| 3,418,751 | 12/1968 | Mabuchi | 46/93 |
| 3,447,258 | 6/1969 | Moore | 46/243 MV |
| 3,772,482 | 11/1973 | Ross | 191/23 R |

*Primary Examiner*—Louis G. Mancene
*Assistant Examiner*—Robert F. Cutting
*Attorney, Agent, or Firm*—Bacon & Thomas

[57] ABSTRACT

Disclosed is a power supplying assembly adapted for conducting electrical current from a current source to a model watercraft being propelled on a water surface. The assembly comprises a generally hollow body adapted for placement below the surface of the water, which body defines one or more, preferably two parallel air chambers each having an access opening for an electrical contact from the watercraft, and one or more electrical conductors extending within each air chamber. This assembly prevents loss of electrical current as a result of contact of the supply conductors with water.

11 Claims, 4 Drawing Figures

POWER SUPPLY FOR MODEL WATERCRAFT

BACKGROUND OF THE INVENTION

The present invention relates to a power supply for model or toy watercraft, and more especially, relates to a power supplying assembly adapted for conducting electrical current from a current source to a model watercraft being propelled on a water surface.

Experience in the toy industry has shown that the optimal means of driving model trains and automobiles upon tracks designed therefor is accomplished by means of motors which are driven by a controlled direct current supply. In these devices, the drive vehicles receive electrical current via the tracks upon which they travel. Such a power supply, however, may not be converted over for use with watercraft because of the conductivity of the water, even if this conductivity is very small. As a result of the salts which are always present in normal tap water, current losses appear through electrolysis, whereas the conducting parts are exposed to increased corrosion.

It has therefore been necessary to deviate from this type of system in the case of model ships and the like, whereby these watercraft have been provided with their own source of energy and controlled by means of radio devices. The control devices required for this type of drive systems are extremely expensive, however, and the energy sources possess only a limited lifetime. Also, the maneuvering properties of such a system are not comparable with those of a directly controllable power supply from an external source.

There have also been attempts heretofore to propel model watercraft by means of chain drive mechanisms. However, this has led to an irregular operation of the craft, whereas the power consumption has been higher than average.

SUMMARY OF THE INVENTION

Accordingly, it is an object of the present invention to provide a device which enables a controllable direct current to be supplied to model watercraft without experiencing the usual disadvantages associated with electrolysis, such as, loss of current, increased corrosion, heating of the water, gas formation, etc.

In accomplishing this object, there has been provided in accordance with the present invention an assembly in which air chambers are arranged under the surface of the water in which electrically conducting tracks extend. Preferably, there is provided an arrangement having two air chambers running parallel to one another, each being provided with one conducting rail or track. In accordance with a preferred embodiment of the invention, the air chambers are formed by a profile body which is formed with a cross section which is essentially in the form of a trapezoid. The upper edge of this body is provided with a longitudinal recess wherein both edges extend downwardly and are arranged as two parallel extending strips running in a vertical plane. The height of these strips which are arranged at the edge of the longitudinal recess corresponds advantageously to the height at which the side walls of the water container extend above the surface of the water contained therein.

Other objects, features and advantages of the present invention will be apparent from the following detailed description of the invention when considered with reference to the attached figures of drawing.

DETAILED DESCRIPTION OF THE INVENTION

Figure 1:
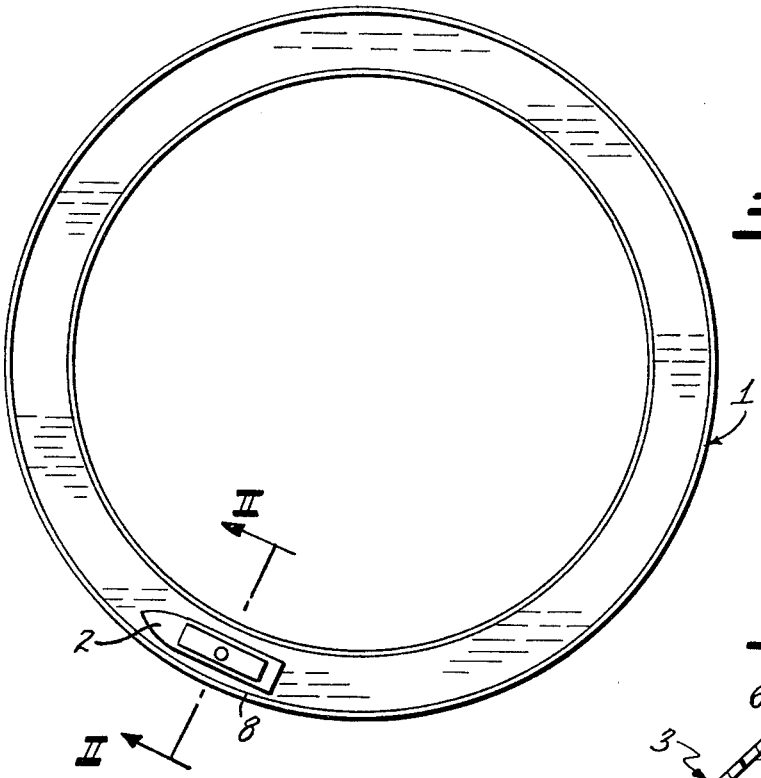
FIG. 1 is a top view of an annular water canal according to the invention having a model ship positioned upon the water contained therein.

Referring now to the drawings, the canal illustrated in FIG. 1 (the structure of which will be discussed in detail below) can consist, for example, of individual sections which may be of interlocking configuration, corresponding to the tracks of a model train set, and may be connected together into a multitude of different forms. For simplification, the canal illustrated in FIG. 1 is put together in the form of a ring. The canal 1 is filled with water and is adapted to accept a model ship 2 having a relatively shallow draft.

Figure 4:
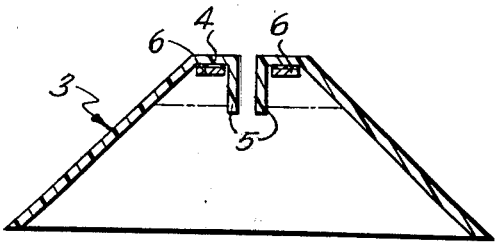
FIG. 4 is a cross sectional view of the air chamber arrangement of the invention presented in still larger scale.

The structure of the power supplying assembly according to the invention will be described in detail with particular reference to FIG. 4 of the drawings. In one embodiment of the invention (FIG. 2) there is placed upon the floor of the canal a shaped body 3 the cross section of which is shaped essentially like a trapezoid. The upper edge 4 of the body contains a longitudinal recess in which both edges thereof are arranged in the form of vertically downwardly directed, parallel running strips 5. Directly below the upper edge 4 of the body are located the electrical conducting tracks or rails 6 which advantageously are made from a metal of high conductivity, e.g., copper or light metal alloy. The electrically conducting track 6 may be fastened to the shaped body 3 by either adhesive means or screw fastening means or the like. When the shaped body is sunk below the surface of the water, there is formed in each instance an air pocket in the upper area of the body laterally with respect to each of the strips 5. In this manner, contact of the conducting tracks 6 with the water is prevented.

Current may be transmitted from the conducting track 6 to a model watercraft by means of an anchor shaped pressure pad or contact 9 which is pressed into contact against the conducting tracks 6 either by means of a spring or a bouyant force which may be produced by means of a float or the like. The current may then be led over wires to a drive motor which is provided inside of the ship. It is, however, also possible to provide a torpedo-like underwater drive unit which is sufficient to drive the model watercraft.

Figure 2:
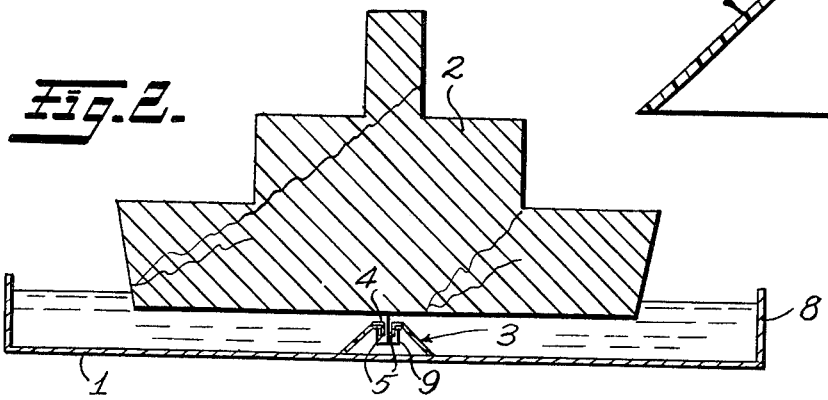
FIG. 2 is a cross sectional view, in greater scale, taken along the line II—II in FIG. 1.
Figure 3:
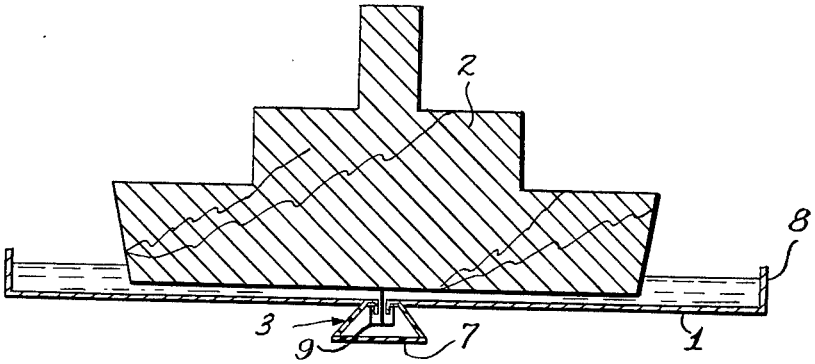
FIG. 3 is a cross sectional view corresponding to that illustrated in FIG. 2, but of another embodiment of the invention.

As stated hereinabove, the shaped body 3 may be placed upon the bottom of the canal. This embodiment is illustrated in FIG. 2 of the drawings. According to another embodiment of the invention (FIG. 3), the shaped body may also be arranged underneath a longitudinal slot provided in the bottom of canal 1. As is clearly shown by a comparison of FIGS. 2 and 3, the water requirement is considerably smaller in connection with the latter embodiment of the invention. The structure of the shaped body differs with respect to the first-mentioned embodiment in the sense that a waterproof floor plate 7 must be provided in the latter embodiment.

An escape of the air from the chambers of the shaped body 3 may be safely prevented if the height of the strips 5 corresponds to the height of the side walls 8 of the canal extending above the surface of the water. In this way, if the canal is tilted, there will result an overflow of the water over the side wall before the air escapes out of the air chambers.

In consequence of the present invention, it becomes possible to carry over to model watercraft the advantages of the controlled direct current supply, which has proven itself in connection with model trains and miniature automobile tracks, while at the same time avoiding the disadvantages discussed in the introductory portion of the application which are associated with electrically conducting tracks standing in contact with water. The shape body 3, which advantageously is constructed of a plastic material, may be easily constructed without great expense. It is possible with the present invention to construct a canal system for model watercraft requiring only a small amount of water, whereby the craft may be controlled in a manner which is conventional for model railroad sets.

What is claimed is:

1. A power supplying assembly adapted for conducting electrical current from a source thereof to a model watercraft being propelled on the surface of a liquid contained in a vessel, comprising a generally hollow body adapted for placement below said liquid surface, said body defining at least one air chamber therein having access means for an electrical contact member associated with said craft, means for supporting said body on the bottom of the vessel containing said liquid and at least one electrical conductor contained within said air chamber, said air chamber being bounded by at least one lip member depending downwardly from the top surface of said body, whereby access to said electrical conductor is made by the electrical contact member passing under said lip.

2. A power supplying assembly as defined by claim 1, wherein said body defines two air chambers extending parallel to one another.

3. A power supplying assembly as defined by claim 1, wherein said body comprises a generally flat top surface and said top surface includes a longitudinal slot, at least one edge of which includes said downwardly depending lip.

4. A power supplying assembly as defined by claim 1, wherein said generally hollow body has a cross section of substantially trapezoidal configuration, the top surface of said trapezoid having a longitudinal slot, both edges of which having downwardly depending lip members extending parallel to one another.

5. A power supplying assembly as defined by claim 1, wherein said vessel comprises a model watercraft pathway comprising a generally U-shaped trough.

6. A power supplying assembly as defined by claim 5, wherein the height of said lip members corresponds approximately to the distance between the surface of said water and the top of said generally U-shaped trough member.

7. A power supplying assembly as defined by claim 5, wherein said hollow body rests upon the bottom of said generally U-shaped trough member.

8. A power supplying assembly as defined by claim 5, wherein said generally U-shaped trough member has a longitudinal slot positioned in its bottom and said hollow body comprises a longitudinal slot in its top surface, at least one edge of which includes said downwardly depending lip member and said body is arranged below said slot in such a manner that the respective slots cooperate.

9. A power supplying assembly as defined by claim 1, wherein said hollow body is constructed of a synthetic resinous material.

10. A power supplying assembly as defined by claim 1 further comprising an electrical contact member attached to the bottom of a flat bottomed craft and positioned to make electrical contact with said electrical conductor.

11. The power supplying assembly as defined by claim 3, wherein both edges of said slot include said downwardly depending lip.

* * * * *